US005346404A

United States Patent [19]

Shimada

[11] Patent Number: 5,346,404

[45] Date of Patent: Sep. 13, 1994

[54] SURFACE MOUNTING CONNECTOR

[75] Inventor: Masashi Shimada, Atsugi, Japan

[73] Assignee: Minnesota Mining and Manufacturing Company, St. Paul, Minn.

[21] Appl. No.: 73,931

[22] Filed: Jun. 8, 1993

[30] Foreign Application Priority Data

Jun. 16, 1992 [JP] Japan ..... 4-156390

[51] Int. Cl.[5] ..... H01R 13/629

[52] U.S. Cl. ..... 439/108; 439/381; 439/79

[58] Field of Search ..... 439/79, 381, 108, 607

[56] References Cited

U.S. PATENT DOCUMENTS 4,200,347 4/1980 Sinclair et al. ..... 439/381
4,913,664 4/1990 Dixon et al. ..... 439/607
5,213,515 5/1993 Ishikawa et al. ..... 439/79
5,267,875 12/1993 Koegel et al. ..... 439/607

FOREIGN PATENT DOCUMENTS 257583 10/1990 Japan ..... 439/607
3-134972 6/1991 Japan .
3133070 6/1991 Japan ..... 439/79
2095485 9/1982 United Kingdom ..... 439/79

*Primary Examiner*—Gary F. Paumen
*Attorney, Agent, or Firm*—Gary L. Griswold; Walter N. Kirn; John C. Barnes

[57] ABSTRACT

A surface mounting connector having an alignment block that can be used without boring redundant holes on a circuit board is supported by the connector body and has holding grooves for receiving and holding the terminal leads. The connector body and alignment block have locating means and fixtures for locating the alignment block at a given position.

6 Claims, 4 Drawing Sheets

SURFACE MOUNTING CONNECTOR

DETAILED DESCRIPTION OF THE INVENTION

1. Field of the Invention

The present invention relates to a surface mounting connector, and in one aspect to an improved alignment block supported by the connector to engage the terminal leads.

2. Description of the Prior Art

A surface mounting technique has been developed recently, wherein electronic components are mounted on a wiring pattern formed on the surface of a circuit board. This has evoked a demand for a surface mounting connector having high-density terminal leads. When terminal leads are close spaced or dense, the terminal leads must still be isolated mutually. The tail contacts of the terminal leads must be in contact with a soldering pad of a circuit board without any positional deviation.

Japanese Patent Laid-Open No. 3-134972 has disclosed that an alignment block for holding terminal leads at regular intervals is combined with a connector body having terminal leads. FIG. 7 shows an example of such a surface mounting connector. In FIG. 7, a connector body 1 has terminal leads 2, which itself functions as a connector. The connector body 1 has locating bosses 3 to be inserted into holes of a circuit board (not shown) and holes 4 for fixing the connector body 1 on the circuit board. An alignment block 5 having holes through which the terminal leads are routed is attached to the connector body 1. The alignment block 5 holds the terminal leads 2 in the vicinity of the tail contacts at regular intervals.

An alignment block 5 is used in combination with a connector body 1, which however, must be mounted on a circuit board independently of the connector body 1. Therefore, the alignment block 5 has locating bosses 3 to be fitted into holes on the circuit board, tail contacts of terminal leads 2 are inserted into dedicated holes on the circuit board. Therefore, holes for receiving the locating bosses 3 and holes for receiving the tail contacts of the terminal leads 2 must be formed on the circuit board.

However, in surface mounting it is not preferable that redundant holes be bored on a circuit board. When a doublesided surface mounted circuit board is concerned, for example, if holes are bored to mount components on one side, a circuit pattern to be formed on the reverse side is restricted. This is a disadvantage. There is, therefore, increasing demand for a surface mounting connector having an alignment block that is usable without boring redundant holes on a circuit board. It is time-consuming to sequentially route terminal leads 2 through holes of the alignment block 5. Incorporation of a holding means is required to permit easy holding and isolation of the terminal leads 2.

The purpose of the present invention is to provide a surface mounting connector having an alignment block that is usable without boring redundant holes on a circuit board.

SUMMARY OF THE INVENTION

A surface mounting connector according to the present invention comprises a connector body having terminal leads exiting therefrom and disposed to engage the surface of a circuit board, and an alignment block supported by the connector body to engage the terminal leads intermediate the ends thereof and having grooves for receiving the terminal leads, the connector body having locating means for locating the alignment block at a given position.

In the foregoing configuration, the alignment block is supported by the connector body, located at a given position by the locating means, and then locked thereat. The alignment block has holding grooves for holding the terminal leads. The terminal leads are sequentially held in the holding grooves.

DESCRIPTION OF THE PRESENT INVENTION

Figure 1:
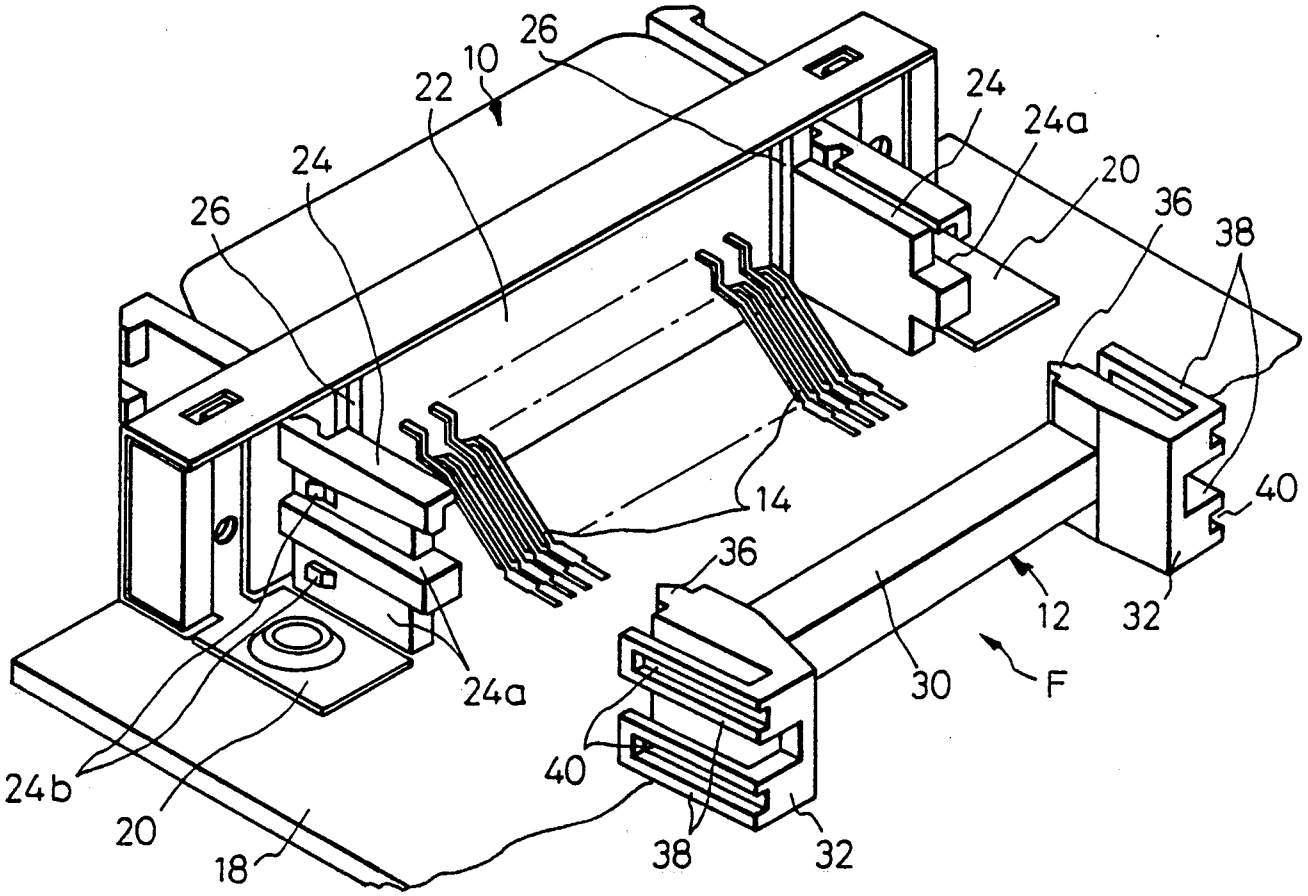
FIG. 1 is a perspective view showing an embodiment of the present invention.

FIG. 1 is a perspective view showing a surface mounting connector of an embodiment of the present invention. The surface mounting connector comprises a connector body 10 and an alignment block 12. The connector body 10 has many terminal leads 14 arranged in such a way that the distal portions will be positioned lower.

Figure 2:
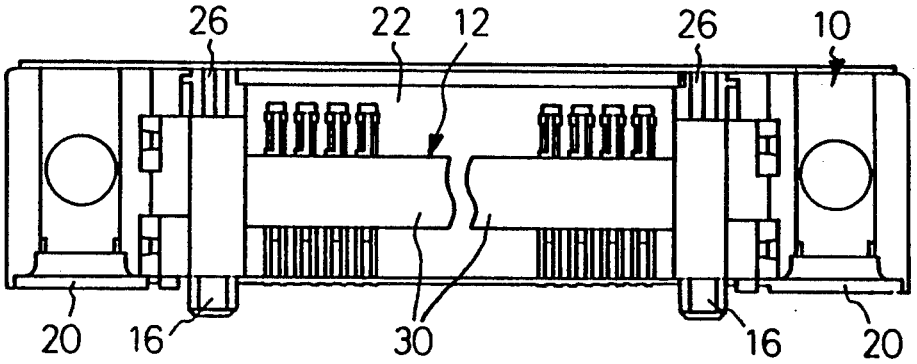
FIG. 2 is a front view of the assembly of FIG. 1.
Figure 3:
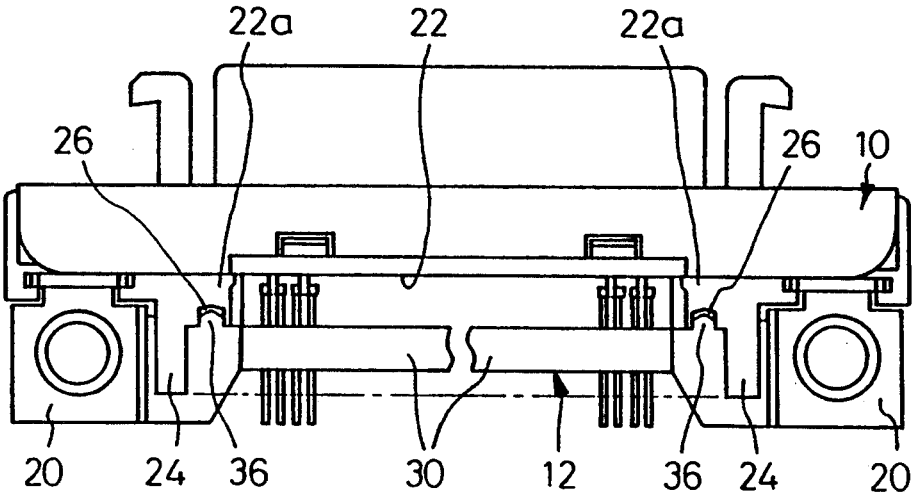
FIG. 3 is a plan view of the assembly of FIG. 1.

In FIG. 1, the alignment block 12 is not attached to the connector body 10. FIG. 2 is a front view of the assembled surface mounting connector of FIG. 1, which is viewed in the F arrow direction. FIG. 3 is a plan view of the assembled surface mounting connector of FIG. 1.

The connector body 10 has locating bosses 16 on its bottom (FIG. 2). The locating bosses 16 are inserted into locating holes on a circuit board 18. Ground plates 20 are attached to the sides of the connector body 10, and when the ground plates 20 are soldered or screwed on the circuit board 18, the connector body 10 is fixed to the circuit board 18. The ground plate 20 is an L-shaped plate made up of a base section lying parallel with the circuit board and a vertical section. The vertical section is connected to a shield enclosing the connector body 10.

The connector body 10 has a front wall 22. Terminal leads 14 are locked in internal holes of the front wall 22 and the leads extend forward in array from the front wall 22. Body side sections 24 are located outside the array of the terminal leads 14, and extend forward from the front wall 22. The ground plates 20 are located immediately outside the body side sections 24. The body side sections 24 have horizontal guides **24*a*. Locking pawls 24*b* are formed at the deep end of the guides 24*a***.

Figure 4:
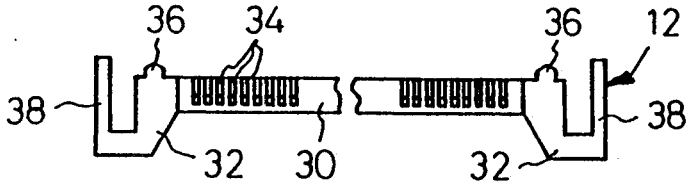
FIG. 4 is a bottom view of an alignment block

An alignment block 12 comprises a rod-type transverse member 30 extending across terminal leads 14 and locating fixtures 32 are formed on both ends of the transverse member 30 as part of the transverse member 30. The transverse member 30 is provided with holding grooves 34 shown in FIGS. 4 to 6. The holding grooves 34 are formed on the bottom of the transverse member 30 with the same pitch as the terminal leads 14 fixed on a connector body 10. The width (a) of each of the holding grooves 34 is a little larger than that of each of the terminal leads 14. The terminal leads 14 fixed on the connector body 10 are, therefore, easily fitted in the holding grooves 34 of the alignment block 12.

Figure 5:
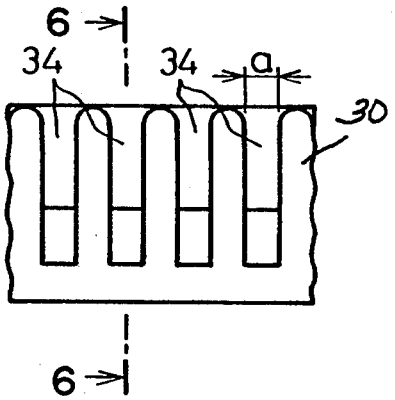
FIG. 5 is an enlarged view of part of FIG. 4.
Figure 6:
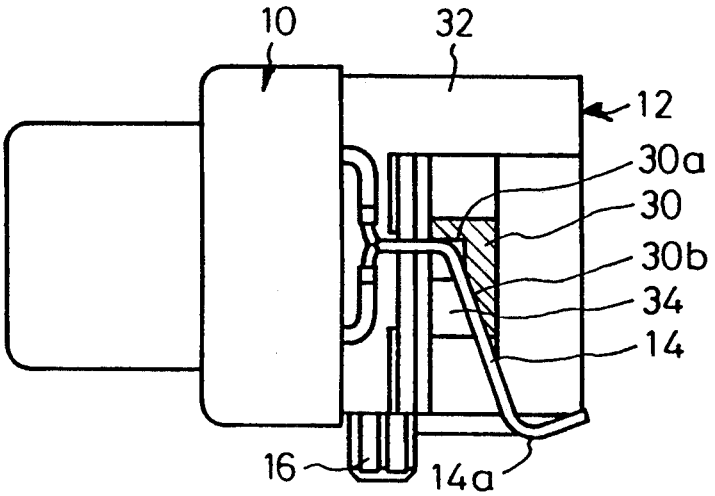
FIG. 6 is a cross sectional view taken along a line 6—6 of FIG. 5 of an assembled connector.
Figure 7:
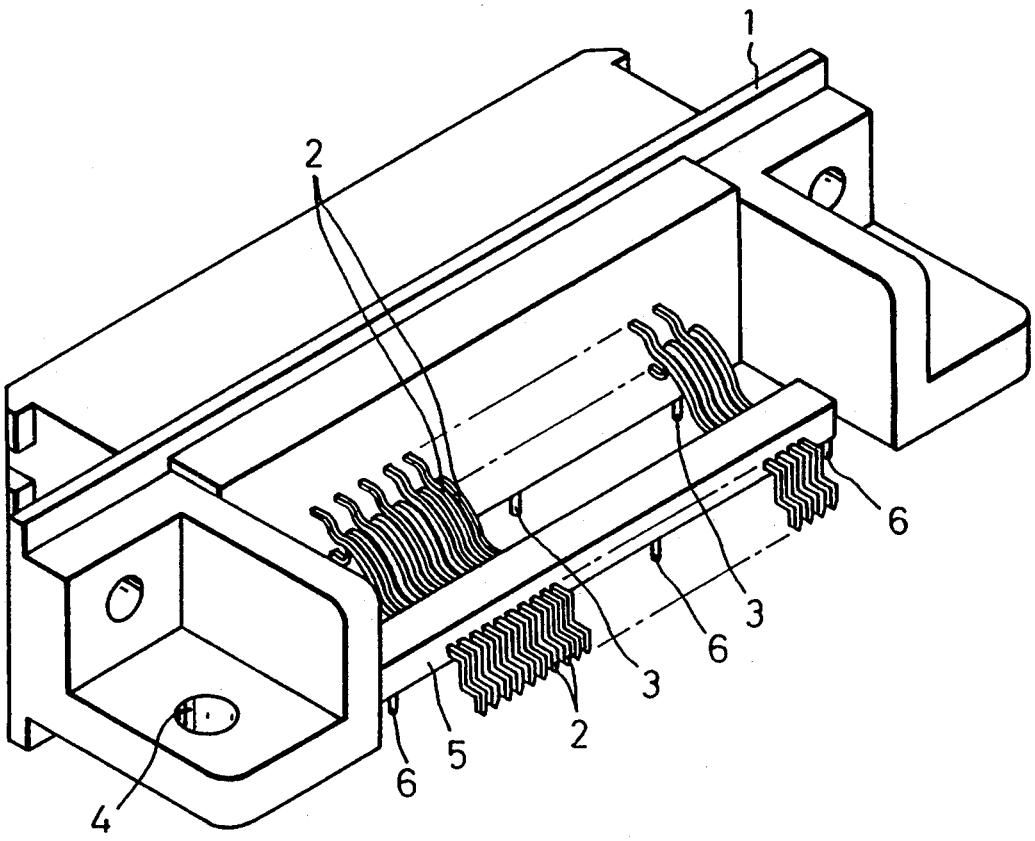
FIG. 7 PRIOR ART
FIG. 7 is a perspective view of the prior art.

Both sides of each of the holding grooves 34 are distanced by the width (a) see FIG. 5. As shown in FIG. 6, the bottom of the holding groove 34 includes a first surface 30*a* and a second surface 30*b*. The first surface 30*a* matches an almost horizontal section of the terminal lead 14, and the second surface 30*b* matches an oblique section of the terminal lead 14. Thus, the holding groove 34 restricts a lateral position of the terminal lead 14 using both sides and the vertical and axial positions of the terminal lead 14 using the surfaces 30*a* and 30*b*. Therefore, tail contacts 14*a* can be brought into contact with a pad on a circuit board 18 without causing a positional deviation. As a result, according to the present invention, the distance from the front wall 22 of a connector body 10 to the tail contacts 14*a* of the terminal leads 14 can be reduced and thereby help achieve high-density surface mounting.

In FIGS. 1 to 4, locating fixtures 32 are attached to both sides of an alignment block 12. The locating fixtures 32 have V-shaped locating projections 36 to be fitted in locating grooves 26 on a front wall 22 of a connector body 10. The locating projections 36 are fitted in the locating grooves 26 by matching an alignment block 12 and the connector body 10.

In FIGS. 1 to 4, locating fixtures 32, attached to both sides of an alignment block 12, have guides 38 that cooperate with guides 24*a* of body side sections 24 of a connector body 10. The guides 38 can slide along the guides 24*a* to restrict the positions of the alignment block in the lateral and vertical directions of the connector body 10, and when the guides 38 are slide along the guides 24*a*, the alignment block 12 and connector body 10 match each other. Finally, locating projections 36 are fitted in locating grooves 26. The locating grooves 26 are formed approximately on the axial lines of locating bosses 16 of the connector body 10. Therefore, the alignment block 12 can be located precisely despite warps of the connector body 10 and alignment block 12 that is made of plastic. The guides 38 have elongated holes 40. The end walls of the elongated holes go beyond pawls 24*b* of the guides 24*a*. When the pawls 24*b* of the guides 24*a* are fitted in the elongated holes 40, the alignment block 12 is fixed to the connector body 10. The lower guides 38 press against a surface of the base sections of the ground plates 20 located parallel with a circuit board. This prevents the tilting of ground plates 20.

As described previously, according to the present invention, an alignment block is supported by a connector body even when redundant holes are not bored on a circuit board. Terminal leads can be easily held at given positions.

I claim:

1. A surface mounting connector comprising a connector body, said connector body having sides and ends, terminal leads exiting from one side and disposed to engage the surface of a printed circuit board, and body side sections located outside the terminal leads and extending from said one side, said body side sections having guide means extending from the extended end of said body side sections toward said one side, and an alignment block supported by the connector body to engage said terminal leads intermediate the ends thereof and having spaced grooves each with an open side facing said one side of said connector body for receiving the terminal leads, said alignment block having ends defining location fixtures that cooperate with said guide means of said body side section for locating the alignment block in position in relationship to said connector body and said terminal leads for restricting lateral, vertical and axial movement of said terminal leads.

2. A surface mounting connector according to claim 1, wherein the connector body has a boss for engaging a locating hole of a circuit board, said locating means being positioned on an axis of said boss.

3. A surface mounting connector according to claim 1, wherein the grooves of the alignment block for holding the terminal leads are provided in a cross member extending on a line crossing the terminal leads, each of the grooves engaging with a respective one of the terminal leads at least two positions.

4. A surface mounting connector according to claim 2, wherein the grooves of the alignment block for holding the terminal leads are provided in a cross member extending on a line crossing the terminal leads, each of said grooves engaging with one of the terminal leads in at least two positions.

5. A surface mounting connector according to claim 1, wherein said connector body and one of sad locating fixtures of the alignment block engages with a surface of the ground plate.

6. A surface mounting connector comprising a connector body having terminal leads exiting therefrom and disposed to engage the surface of a printed circuit board, and an alignment block supported by the connector body to engage the terminal leads intermediate the ends thereof and having grooves for receiving the terminal leads, the connector body having locating means for locating the alignment block in position, said connector body having a boss for engaging a locating hole of a circuit board, said locating means being positioned on an axis of said boss, and wherein said connector body has a ground plate fixed to a said circuit board and the alignment block engages with a surface of said ground plate.

* * * * *

UNITED STATES PATENT AND TRADEMARK OFFICE

CERTIFICATE OF CORRECTION

PATENT NO. : 5,346,404
DATED : September 13, 1994
INVENTOR(S) : Masahi Shimada

It is certified that error appears in the above-indentified patent and that said Letters Patent is hereby corrected as shown below:

Column 4, Line 39, "body and" should read -- body has a ground plate fixed to said connector body and --.

Column 4, Line 39, "one of sad locating" should read -- of said locating --.

Column 4, Line 53, "said circuit" should read -- said connector body for connecting said connector body to a said circuit --.

Signed and Sealed this

Ninth Day of May, 1995

Bruce Lehman

*Attest:*

BRUCE LEHMAN

*Attesting Officer*

*Commissioner of Patents and Trademarks*